US006401708B1

(12) United States Patent
Kim et al.

(10) Patent No.: US 6,401,708 B1
(45) Date of Patent: Jun. 11, 2002

(54) PRESSURE SENSING DEVICE IN GAS FURNACE AND METHOD FOR CONTROLLING OPERATION THEREOF

(75) Inventors: Kyeong Soo Kim, Pusan; Yeong Soo Kim, Kyongsangnam-do; In Kyu Kim, Kyongsangnam-do; Yang Ho Kim, Kyongsangnam-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/512,374

(22) Filed: Feb. 25, 2000

(30) Foreign Application Priority Data

Feb. 26, 1999 (KR) ..... 99/6548

(51) Int. Cl.[7] ..... F23N 5/24
(52) U.S. Cl. ..... 126/116 A; 431/20
(58) Field of Search ..... 431/20, 18, 19; 126/116 A, 85 B, 116 R; 417/44.2, 53; 340/608, 611

(56) References Cited

U.S. PATENT DOCUMENTS 4,251,025 A * 2/1981 Bonne et al. ..... 431/12
4,708,636 A * 11/1987 Johnson ..... 431/20
4,885,573 A * 12/1989 Fry et al. ..... 431/18
5,132,500 A * 7/1992 Clew ..... 73/723
5,190,452 A * 3/1993 Katchka et al. ..... 126/116 A
5,253,635 A * 10/1993 Overall ..... 126/85 B
5,331,944 A * 7/1994 Kujawa et al. ..... 126/116 A
5,456,597 A * 10/1995 Lazar et al. ..... 431/19
5,601,071 A * 2/1997 Carr et al. ..... 431/20
5,612,904 A * 3/1997 Bunting ..... 431/18
5,819,721 A * 10/1998 Carr et al. ..... 431/20
5,993,195 A * 11/1999 Thompson ..... 431/20
6,109,255 A * 8/2000 Dieckmann et al. .... 126/116 R
6,234,164 B1 * 5/2001 Yasui ..... 126/116 A

* cited by examiner

*Primary Examiner*—Sara Clarke
(74) *Attorney, Agent, or Firm*—Fleshner & Kim, LLP

(57) ABSTRACT

Pressure sensing device in a gas furnace including a first tube in communication with a position of an air supply pipe on an inlet side of an air supply fan having a pressure identical to an inlet of the air supply fan, a second tube in communication with a position of an air supply pipe on an outlet side of the air supply fan having a pressure identical to an outlet of the air supply fan, and a pressure difference sensing means respectively connected to the first and second tubes for providing an electric signal according to a pressure difference caused by pressure on the first and the second tubes, thereby detecting clogging states both of the air supply pipe and the exhaust gas pipe, and method for controlling operation of a gas furnace, including the steps of (1) a pressure difference sensing device providing an electric signal according to a pressure difference between inlet/outlet of an air supply fan during operation or a pre-purge step for starting operation, (2) comparing the electric signal to a preset signal at the controller, and (3) either stopping the operation or continuing a normal operation according to a pressure state detected in the comparing step.

15 Claims, 8 Drawing Sheets

<normal state>

(air supply pipe 100% clogged>

<exhaust gas pipe 100% clogged>

PRESSURE SENSING DEVICE IN GAS FURNACE AND METHOD FOR CONTROLLING OPERATION THEREOF

BACKGROUND OF THE INVENTION

1. Field of the Invention

The present invention relates to a gas furnace, and more particularly, to a device for sensing an internal pressure difference of a gas furnace, and a method for controlling operation of the gas furnace by using a pressure sensing device.

2. Background of the Related Art

In general, the gas furnace is a device which alters cold air into a warm air by a heat exchange using a heat from combustion of gas, and heats a room by using the warm air. A basic structure of such a gas furnace is shown in FIG. 1, referring to which the gas furnace will be explained. There is an air inlet 2 at a lower portion of a front surface of a body 1 for drawing cold air in the room, and an air outlet 4 at an upper portion of the front surface of the body 1 for discharging the air heat exchanged in the gas furnace. And, there is a partition 15 having an opening between opposite sidewalls of the body 1 to divide an inside cavity of the body 1, a combustion chamber 6 over the partition for burning the gas, and a housing 2 under the partition having a blower 3 mounted therein. There is a burner 7 in the combustion chamber 6 connected to a gas supply tube 8 for mixing air and gas, and igniting the mixed gas for producing flame, and a gas shut off valve between the gas supply tube 8 and the burner 7 for selective shut off of the gas supply. And, there is a heat exchanger 13 over the combustion chamber for altering a cold air drawn inside of the body 1 by movement of exhaust gas into warm air. There is an exhaust gas pipe 14 connected to the heat exchanger 13 for discharging the exhaust gas heat exchanged with the cold air, and an air supply pipe 9 to the burner 7 for supplying fresh air required for combustion. And, there is an air supply fan 11 connected to the air supply pipe for supplying the fresh air to the burner 7. There is a space at one side of the upper portion of the partition 15 for mounting various parts including a controller 16, and a barrier 5 for supporting the parts. Such a gas furnace conducts a pre-purge when the gas furnace is put into operation, in which a fresh air from the air supply fan 11 is passed through the combustion chamber 6, the heat exchanger 13 and the exhaust gas pipe 14 for a few minutes without burning the gas for driving out unburned gas remained in the combustion chamber 6 and etc. After the pre-purge process is finished, an actual combustion is started in the combustion chamber 6, and the fresh air introduced from outside of the gas furnace by the air supply fan 3 is heated as the air passes through the combustion chamber 7 and the heat exchanger 13. Finally, the heated air is supplied to the room through a discharge hole 10, and the gas furnace keeps supplying the heated air until a preset temperature is reached. In this instance, the pre-purge is carried out as the air supply fan 11 is operated by the controller 16, and, after the pre-purge is finished, the combustion is carried out as the gas valve 12 is opened by the controller 16. However, in using the related art gas furnace, there are cases in actual operation of the gas furnace when the air supply pipe or the exhaust gas pipe are clogged from various reasons, that impedes normal operation of the gas furnace. That is, if a combustion process is conducted in a state the air supply pipe 9 or the exhaust gas pipe is clogged, the mixed gas is burned in the combustion chamber incompletely because fresh air supply to the combustion chamber is reduced significantly in comparison to the gas supply. This incomplete combustion may cause explosion of the unburned gas in the combustion chamber 6, pollution of an environment, or inflow of the unburned gas into the room.

In the meantime, in order to solve this problem, the applicant filed a patent, Korea Patent application No. 98-38517, titled "device and method for sensing an air pressure in a gas furnace", of which systems are shown in FIGS. 2A and 2B, schematically. The application suggests to provide an air pressure sensing switch for sensing a supply side pressure either on an inlet side or an outlet side with reference to the air supply fan 11, for sensing clogging of the air supply pipe 9 and the exhaust gas pipe 14 according to a difference of the air pressure sensed by the air pressure sensing switch and the atmospheric pressure. In detail, as shown in FIG. 2A, in a first embodiment of the Korea patent application No. 98-38517, a first air opening of the air pressure sensing switch is connected to the air supply pipe on the inlet side of the air supply fan 11, and the second air opening is opened to the air. And, as shown in FIG. 2B, in a second embodiment of the Korea patent application No. 98-38517, the first air opening of the air pressure sensing switch is opened to the air, and the second air opening is connected to the air supply pipe on the outlet side of the air supply fan 11. In the foregoing embodiments of the Korea patent application No. 98-38517, the air pressure switch generates a signal only when a pressure difference($\Delta P$=a second air opening pressure—a first air opening pressure) between the second air opening pressure and the first air opening pressure is increased.

In the meantime, when it is assumed that an inlet side pressure is P1 and an outlet side pressure is P2 with reference to the air supply fan 11, the pressures P1 and P2 are the first air opening pressure and the second air opening pressure, respectively. And, both pressures P1 and P2 are reduced when the air supply pipe 9 is clogged, and increased when the gas exhaust pipe 14 is clogged. However, as explained, while the air pressure switch generates the signal only when the pressure difference is increased, and the pressure difference of the air pressure switch is reduced sometimes depending on conditions, such as clogging of the air supply pipe 9 or clogging of the exhaust gas pipe 14. That is, when the gas exhaust pipe 14 is clogged in the first embodiment, a pressure difference($\Delta P=P_2$-atmospheric pressure) of the air pressure switch is dropped as an outlet pressure $P_2$ of the air supply fan 11 is dropped. Therefore, in the invention disclosed by the Korea patent No. 98-38517, clogging of the air supply pipe 9 only is sensed when the air pressure sensing switch is fitted to the inlet side of the air supply fan 11 of the air supply pipe 9, and clogging of the exhaust gas pipe 14 only is sensed when the air pressure sensing switch is fitted to the outlet side of the air supply fan 11. Accordingly, there has been a problem in that both clogging of the air supply pipe 9 and clogging of the exhaust gas pipe 14 can not be sensed by using one air pressure sensing switch. Though the air pressure sensing switches may be fitted to both the inlet side and the outlet side of the air supply fan 11, the increased number of the air pressure sensing switches leads to an increased production cost and a complicated structure.

SUMMARY OF THE INVENTION

Accordingly, the present invention is directed to a device for sensing an internal pressure difference of the gas furnace, and a method for controlling operation of a gas furnace by using a pressure sensing device that substantially obviates one or more of the problems due to limitations and disadvantages of the related art.

The object of the present invention is to provide a device for sensing a pressure in a gas furnace, and a method for controlling operation of a gas furnace by using a pressure sensing device, which can detect both clogging of an air supply pipe and clogging of an exhaust air pipe.

Other object of the present invention is to provide a device for sensing a pressure which costs low and has a simple structure.

Another object of the present invention is to provide a method for controlling operation of a gas furnace by using a pressure sensing device which can sense clogging both of air supply pipe and an exhaust gas pipe.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the pressure sensing device in a gas furnace includes a first tube in communication with a position of an air supply pipe on an inlet side of an air supply fan having a pressure identical to an inlet of the air supply fan, a second tube in communication with a position of an air supply pipe on an outlet side of the air supply fan having a pressure identical to an outlet of the air supply fan, and a pressure difference sensing means respectively connected to the first and second tubes for providing an electric signal according to a pressure difference caused by pressure on the first and the second tubes, thereby detecting clogging states both of the air supply pipe and the exhaust gas pipe.

A controller is further provided for receiving the electric signal generated at the pressure difference sensing means, comparing to a preset value, and determining clogging of the air supply pipe or the exhaust gas pipe factually.

A timer is further provided for measuring a time period since a clogged state is detected by the controller for re-determining the clogged state detected by the controller within a preset time period.

An informing means is further provided for informing the clogged state of the air supply pipe or the exhaust gas pipe detected or determined at the controller, including at least one selected from a character display for providing an error message, a light for a visual effect, and a buzzer for a hearing effect.

In other aspect of the present invention, there is provided a method for controlling operation of a gas furnace, including the steps of (1) a pressure difference sensing device providing an electric signal according to a pressure difference between inlet/outlet of an air supply fan during operation or a pre-purge step for starting operation, (2) comparing the electric signal to a preset signal at the controller, and (3) either stopping the operation or continuing a normal operation according to a pressure state detected in the comparing step.

The method for controlling operation of a gas furnace, further includes the step of determining the clogged state of the air supply pipe or the exhaust gas pipe factually after the step (2), for stopping the operation or continuing a normal operation according to a pressure state determined in the determining step.

The method for controlling operation of a gas furnace, further includes the step of informing the clogged state to the user by sounding a buzzer or displaying a message before stopping the operation if the present operation state is detected or determined to be the clogged state.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
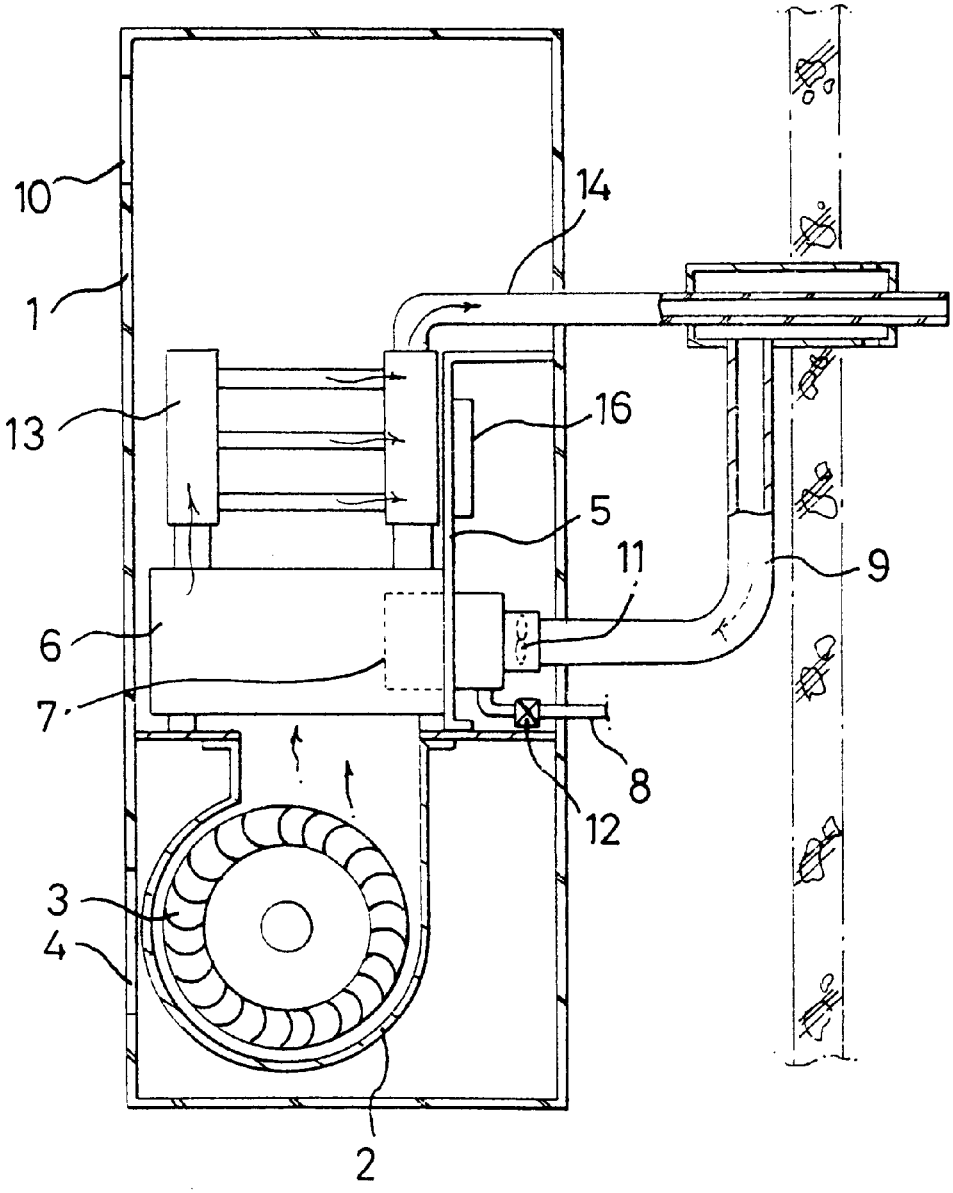
FIG. 1 Related Art
FIG. 1 illustrates a section showing a related art gas furnace.
Figure 2A:
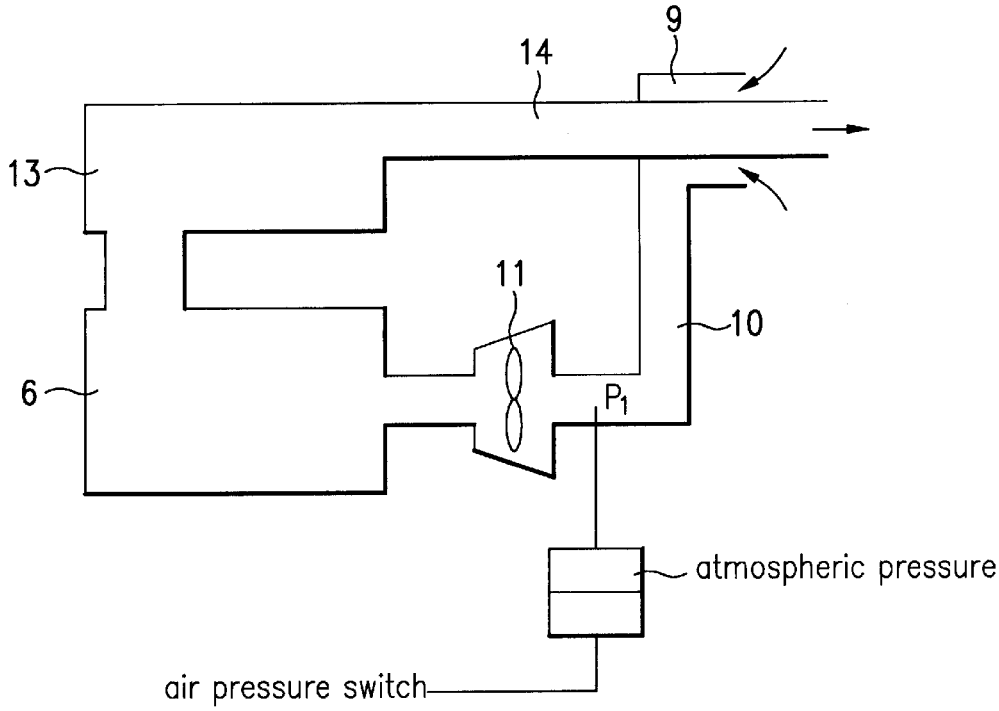
FIG. 2A Related Art
FIG. 2A illustrates an example in which an air pressure switch in a related art device for sensing a pressure fitted to an inlet side of an air supply fan, schematically.
Figure 2B:
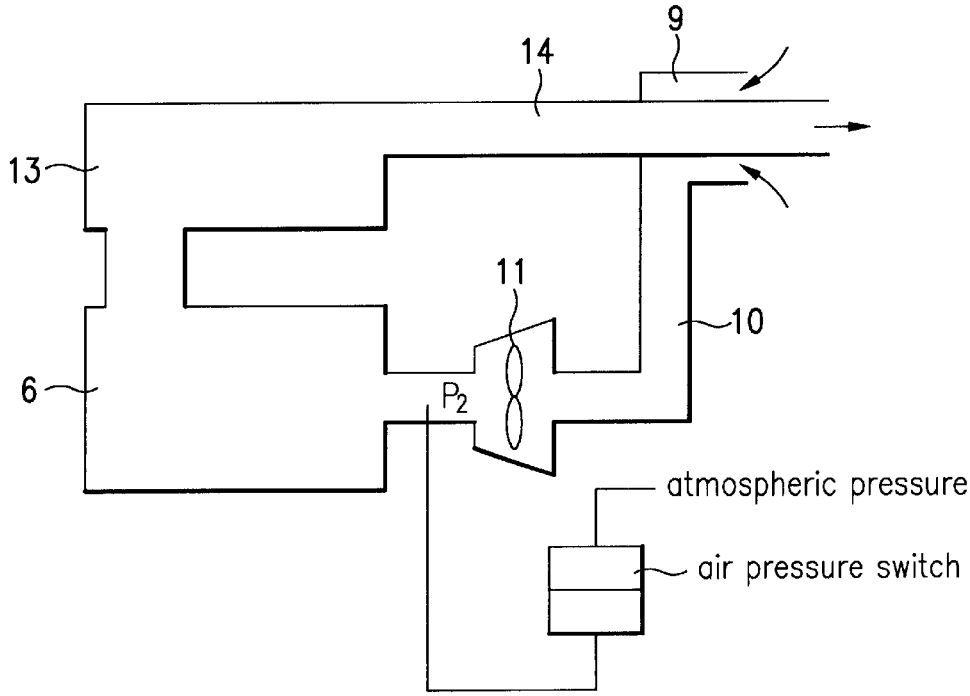
FIG. 2B Related Art
FIG. 2B illustrates an example in which an air pressure switch in a related art device for sensing a pressure fitted to an outlet side of an air supply fan, schematically.
Figure 3:
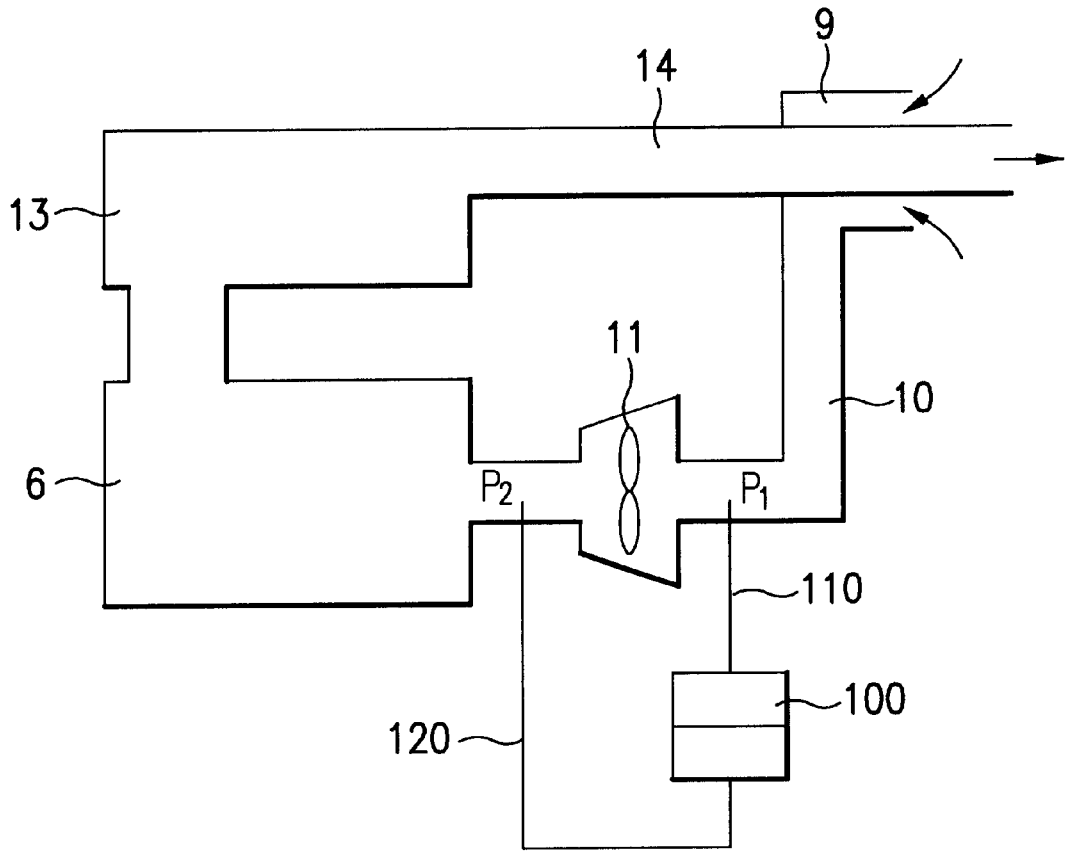
FIG. 3 illustrates a device for sensing a pressure in accordance with a preferred embodiment of the present invention, schematically.

Reference will now be made in detail to the preferred embodiments of the present invention, examples of which are illustrated in the accompanying drawings. In description of the present invention, identical parts will be given the same names and symbols, and explanation for which will be omitted. FIG. 3 illustrates a device for sensing a pressure in accordance with a preferred embodiment of the present invention schematically, referring to which the device for sensing a pressure of the present invention will be explained.

Referring to FIG. 3, the device for sensing a pressure in accordance with a preferred embodiment of the present invention includes a first tube 110 in communication with an air supply pipe on an inlet side of an air supply fan 11, a second tube 120 in communication with an supply pipe on an outlet side of the air supply fan 11, and a pressure difference sensing means 100 connected to the first and second tubes 110 and 120, respectively. The foregoing system of the gas furnace of the present invention leads the first tube 110 to have a pressure $P_1$ identical to an inlet side of the air supply fan 11, and, a likely, the second tube 120 also to have a pressure $P_2$ identical to an outlet side of the air supply fan 11. And, the first and second tubes 110 and 120 are connected to opposite sides of the pressure difference sensing means 100, for generating a pressure difference caused by the pressures in the first and second tubes 110 and 120, i.e., the inlet/outlet pressures P1 and P2 of the air supply fan 11 inside of the pressure difference sensing means 100. The pressure difference sensing means 100 generates an electric signal according to a pressure difference generated therein, which will be explained in detail.

Figure 6A:
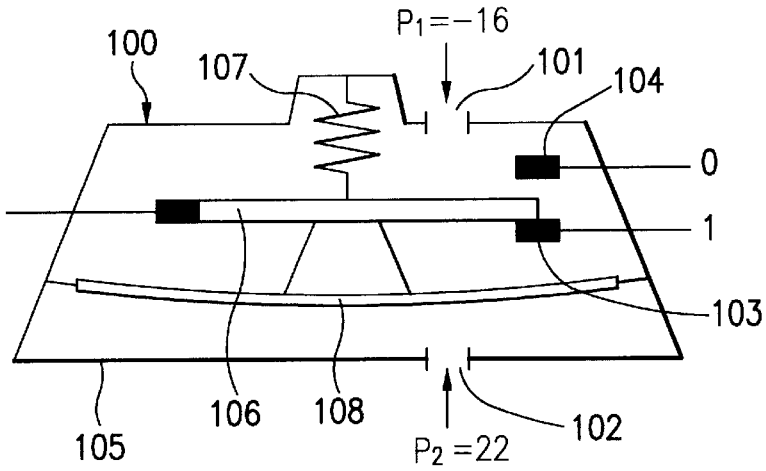
FIG. 6A illustrates a section of means for sensing a pressure difference in accordance with a preferred embodiment of the present invention in a normal condition when both the air supply pipe and the exhaust gas pipe are not clogged.
Figure 6B:
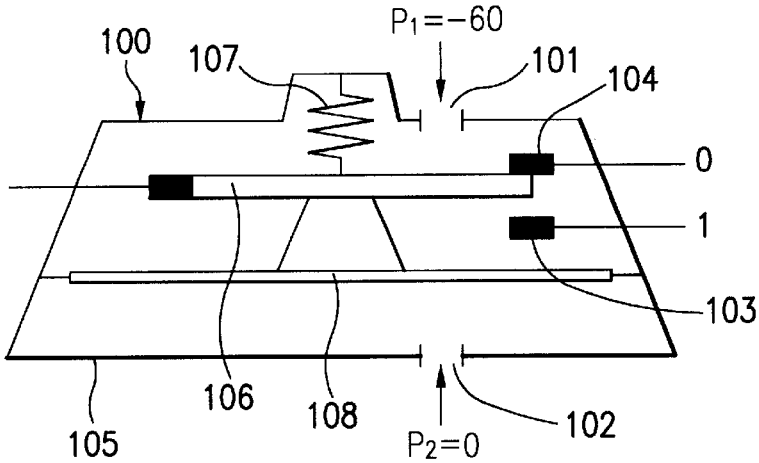
FIG. 6B illustrates a section of means for sensing a pressure difference in accordance with a preferred embodiment of the present invention in a condition when the air supply pipe is clogged, completely.
Figure 6C:
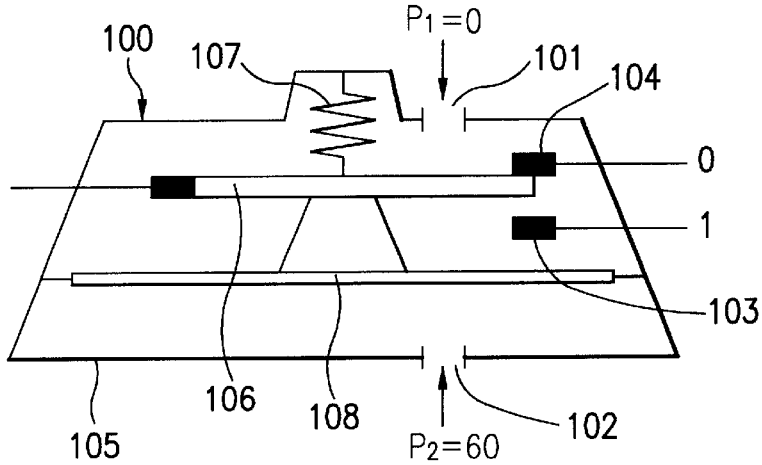
FIG. 6C illustrates a section of means for sensing a pressure difference in accordance with a preferred embodiment of the present invention in a condition when the exhaust gas pipe is clogged, completely.

Referring to FIGS. 6A~6C, there are a first opening 101 and a second opening 102 opposite to each other in a body 105 of the pressure difference sensing means 100 in communication with the first and second tubes 110 and 120. And, there are a first stationary contact 103 and a second stationary contact 104 opposite to, and spaced from each other at one side of inside of the body 105. There is a movable contact 106 between the first and second movable contacts 103 and 104 supported elastically by an elastic member 107 fitted to top of the inside of the body 105. And, the movable contact 106 is also supported by an elastic supporting plate 108 fitted to a lower portion of the body 105. The movable contact 106 moves according to a difference of pressures $P_1$, and $P_2$ provided thereto through the first and second openings 101 and 102, and makes contact to the first and second stationary contacts 103 and 104 selectively, to generate a signal. And, as shown in FIG. 6A, the movable contact 106 is disposed such that the movable contact 106 is in contact with the first stationary contact 103 in a state the elastic member 107 is not deformed 107, such that the elastic supporting plate 108 supports the first stationary contact 103 together with the elastic member 107, with the elastic supporting plate 108 deformed slightly. According to such an arrangement, when the elastic member 107 is contracted by a force applied to the movable contact 106 according to the variation of the pressure difference and the movable contact 106 moves toward the second stationary contact 104, the elastic supporting plate 108 can make a stable support to the movable contact 106, together with the elastic member 107.

Figure 4:
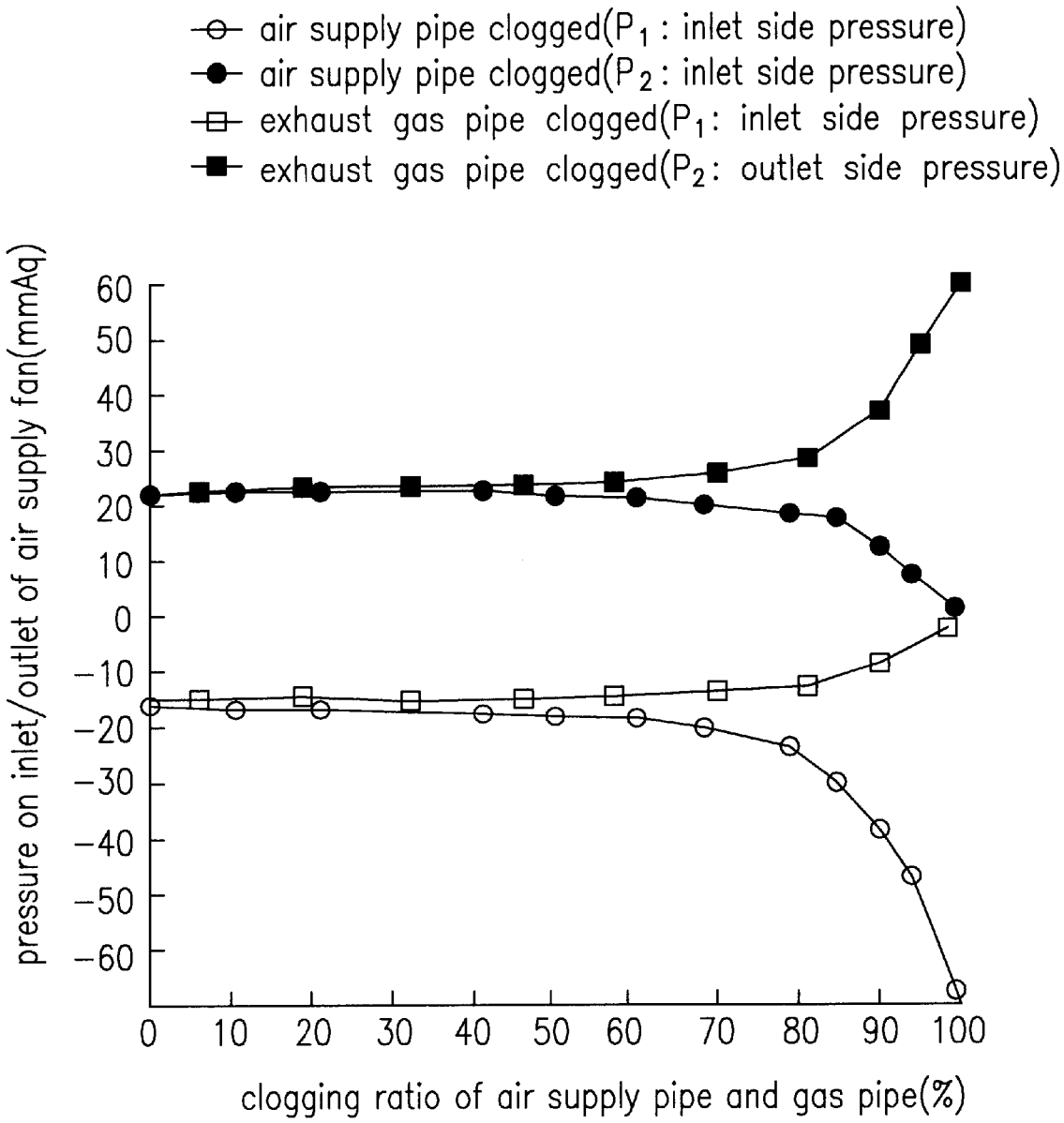
FIG. 4 illustrates a graph showing clogging ratio of an air supply pipe and an exhaust gas pipe vs. change of air supply fan inlet/outlet pressure.
Figure 7:
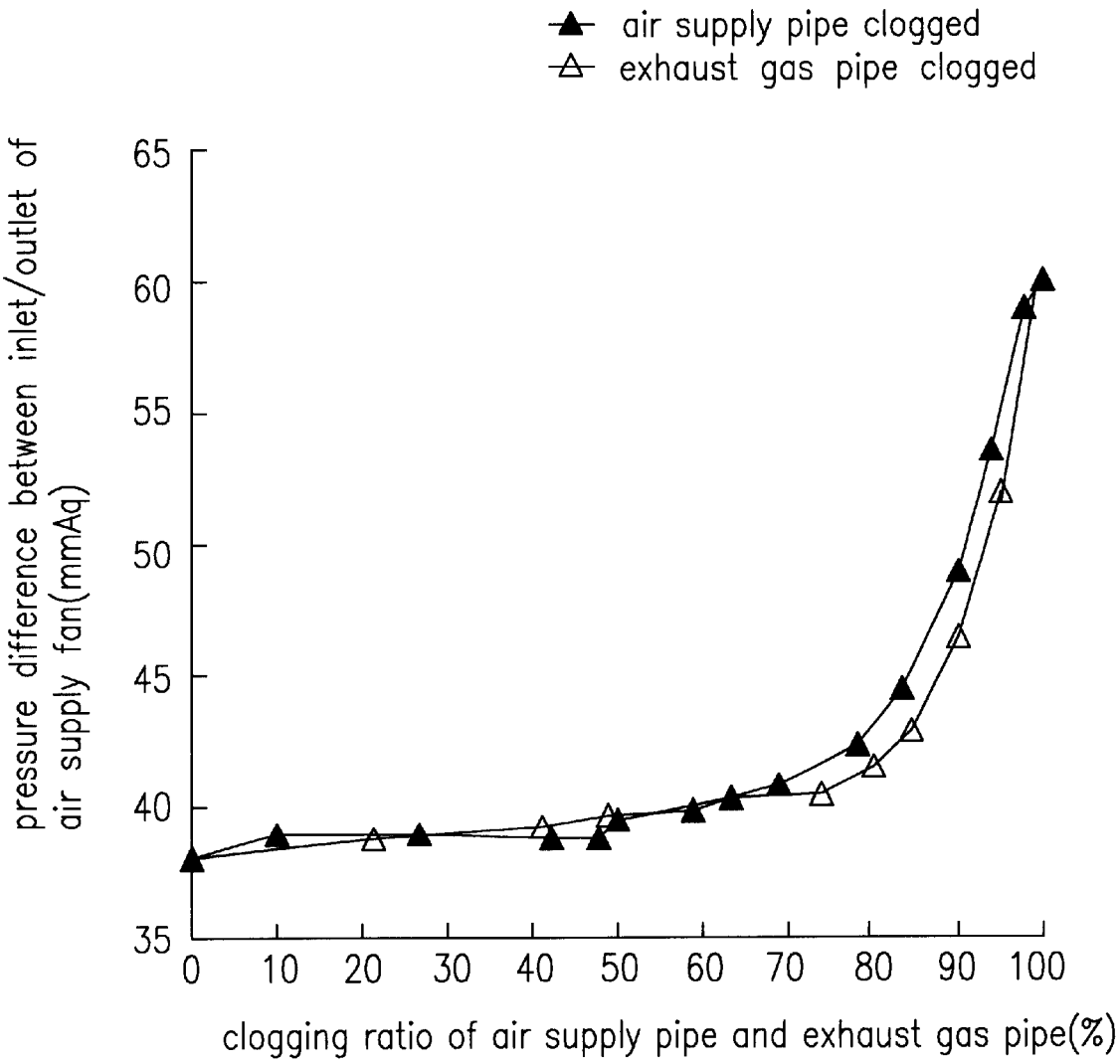
FIG. 7 illustrates a graph showing clogging ratio of air drawing pipe and exhaust pipe vs. a pressure difference change of an air supply fan; and, FIG. 8 illustrates a flow chart showing the steps of a method for controlling operation of a gas furnace in accordance with a preferred embodiment of the present invention.

The operation of the aforementioned device for sensing a pressure in accordance with a preferred embodiment of the present invention will be explained with reference to FIGS. 4 and 7.

Figure 5A:
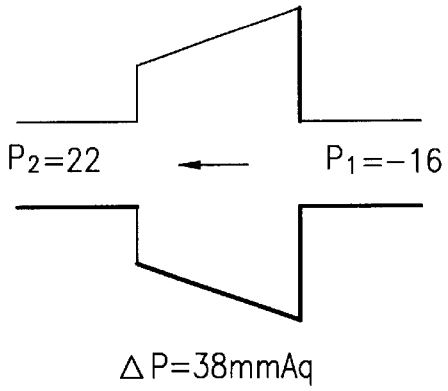
FIG. 5A illustrates a partial schematic drawing showing an example of air supply fan inlet/outlet pressures in a normal condition.
Figure 5B:
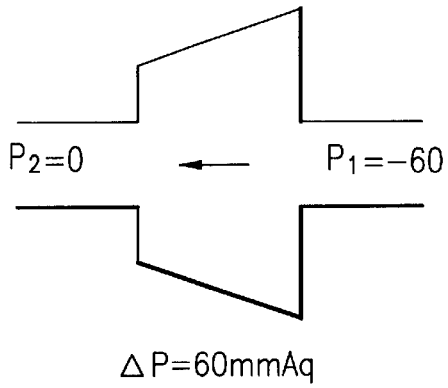
FIG. 5B illustrates a partial schematic drawing showing an example of air supply fan inlet/outlet pressures when the air supply pipe is clogged by 100%.
Figure 5C:
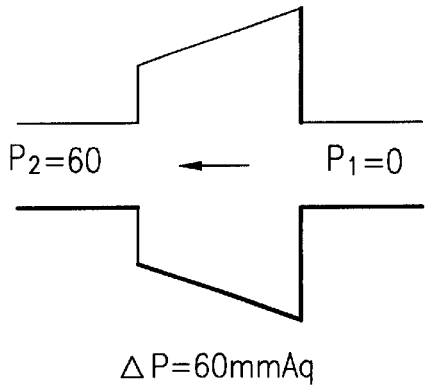
FIG. 5C illustrates a partial schematic drawing showing an example of air supply fan inlet/outlet pressures when the exhaust gas pipe is clogged by 100%.

Pressure states in the gas furnace can be sorted into two; a normal state and an abnormal state in which either the air supply pipe or the exhaust gas pipe is clogged. There are pressures different from each other for respective states at inlet/outlet of the air supply fan 11, which may also be differ depending on specification of the gas furnace, such as a capacity of the air supply fan 11. Therefore, in order to compare the operation (100) of the device for sensing a pressure for various pressure states, it is preferable that one example of the actual pressure values of the inlet/outlet of the air supply fan 11 is specified. FIG. 4 illustrates a graph showing one example of actual pressure states in the air supply pipe and the exhaust gas pipe. As shown in FIG. 4, first in a normal state, i.e., clogging ratios of the air supply pipe and the exhaust gas pipe is zero %, the inlet pressure P1 to the air supply fan 11 is approx. −16 mmAq, and an outlet pressure P2 is approx. 22 mmAq. Since the air supply fan 11 draws external air and supplies it to the combustion chamber 6, it can be understandable that the inlet pressure P1 is negative and the outlet pressure P1 is positive. After the normal state, as the clogging ratio % on the abscissa is increased, the inlet/outlet pressures P1 and P2 on the ordinate are changed gradually. That is, as the clogging ratio of the air supply pipe 9 is increased, both the inlet/outlet pressures P1 and P2 are reduced, and as the clogging ratio of the exhaust gas pipe 14 is increased, both the inlet/outlet pressures P1 and P2 are increased. However, in detail, when the clogging ratio of the air supply pipe 9 is increased, it is shown that a pressure drop of the inlet pressure P1 is greater than a pressure drop of the outlet pressure P2. And, when the clogging ratio of the exhaust gas pipe 14 is increased, it is shown that a pressure increase of the outlet pressure P2 is greater than a pressure increase of the inlet pressure P2. Accordingly, when the air supply pipe is 100% clogged, the inlet and outlet pressures P1 and P2 are −60 mmAq and 0 mmAq respectively, and the exhaust air pipe is 100% clogged, the inlet/outlet pressure P1 and P2 are 0 mmAq and 60 mmAq respectively. In the meantime, in order to permit an appropriate reaction according to the actual pressures, elastic member 107 in the device for sensing a pressure difference 100 is set to start deformation at a pressure of 40 mmAq. Together with such an example of actual pressure values, FIGS. 5A~5C illustrate partial schematic drawings inclusive of air supply fan for respective pressure states, and FIGS. 6A~6C illustrate sections of pressure difference sensing means of the present invention for respective pressure states, referring to which the operation in respective pressure states of the pressure difference sensing means 100 of the present invention can be explained as follows.

Referring to FIGS. 6A~6C, the first and second stationary contacts 103 and 104 are setup to generate signal S of '0' and '1' when the first and second stationary contacts 103 and 104 are brought into contact with the movable contact 106. The pressure signal 'S' '0' denotes that the air supply pipe 9 or the exhaust gas pipe 14 is clogged, and the pressure signal 'S' '1' denotes a normal state. Basically, the movable contact 106 is brought into contact with the second stationary contact 103 by the elastic force of the elastic member 107, to provide a pressure signal 'S' '1'. In a normal state, as shown in FIG. 5A, a deformation starting pressure of the elastic member 107 is set to 40 mmAq, the inlet pressure P1 is set to −16 mmAq, and the outlet pressure P2 is set to 22 mmAq, wherein a pressure difference $\Delta P = P2 - P1$ between the inlet pressure P1 and the outlet pressure P2 is 38 mmAq, smaller than the deformation starting pressure 40 mmAq of the elastic member 107. Therefore, as shown in FIG. 6A, the elastic member 107 makes no deformation, the movable contact 106 keeps generating the pressure signal '1' which represents the normal state. And, as shown in FIG. 5B, when the air supply pipe 9 is clogged(clogging ratio 100%), the inlet pressure P1 is set to −60 mmAq, and the outlet pressure P2 is set to 0 mmAq. In this instance, though both the inlet pressure P1 and the outlet pressure P2 are dropped, the pressure drop of the inlet pressure P1 is significantly greater the outlet pressure P2. According to this, since the pressure difference ΔP=P2−P1 in the pressure difference sensing device 100 is 60 mmAq, greater than the deformation starting pressure 40 mmAq of the elastic member 107, the elastic member 107 is deformed. Then, as shown in FIG. 4C, the movable contact 106 moves upward as the movable contact 106 is supported by the elastic supporting plate 108, and the movable contact 104 is brought into contact with the second stationary contact 104 when a pressure signal S '0' is provided, which represents a clogged state. All the sensing operation of the such a clogged state is caused by an increased pressure difference in the pressure difference sensing means 100, such a conclusion is clearly shown in FIG. 7, the pressure difference of which is measure in an actual experiment.

In the meantime, though operation of the gas furnace can be stopped directly in response to the provided signal 'S', particularly, to '0', it is preferable that a controller 16 is provided, which receives the pressure signal 'S', compares the pressure signal to a preset signal Ss, and determines an actual clogging. It is possible that either the '0' or the '1' is selected as the preset signal Ss, and in the embodiment of the present invention, '0' is selected. For the easy perception of the user of the gas furnace, it is preferable that display means is provided, for displaying the clogged state of the air supply pipe 9 or the exhaust gas pipe 14, the controlled 16 determined, to the user. The display means may be a character display for displaying an error message, a lighting for a visual effect, an buzzer of a hearing effect. On the other hand, even a case when the air supply pipe 9 or the exhaust gas pipe 14 is clogged temporarily by a certain external reason, the gas furnace of the present invention stops its operation. In order to prevent such a case, it is preferable that the pressure difference sensing device of the present invention is provided with a timer, so that the controller 16 determines the clogged state again after a certain time period calculated by the timer once the controller 16 determines the clogged state.

Figure 8:
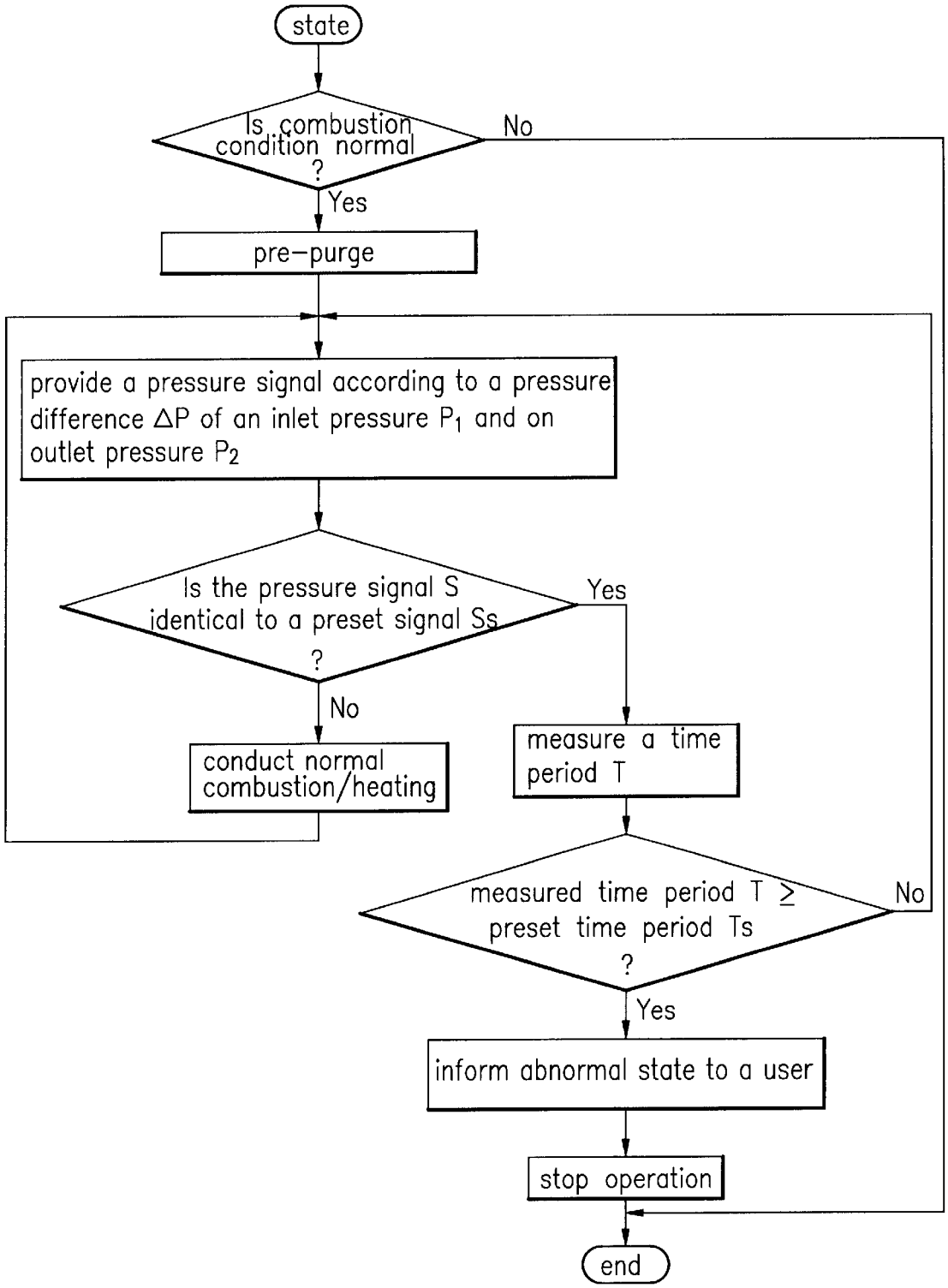

A method for controlling operation of the gas furnace by using the device for sensing a pressure of the present invention will be explained, with reference to FIG. 8.

First, when the user selects a heating mode, the pre-purge is conducted under a state a combustion condition is normal. Then, the pressure difference sensing device 100 provides one pressure signal 'S' according to a pressure difference ΔP between inlet/outlet pressure P1 and P2 of the air supply fan 11 to the controller 16. As described before, the pressure difference sensing device 100 provides '1' in a normal state, and '0' in a clogged state, and a signal value Ss set at the controller 16 is '0'. Though the operation of the gas furnace can be controlled directly by means of the pressure signal S, the pressure signal S is compared at the controller 16 for an operation stability. If the pressure signal S and the set signal value Ss are different, i.e., the provided pressure signal S1 is '1', a normal combustion and heating is conducted. Thereafter, even during the combustion and heating, the steps of providing the pressure signal S and comparing the pressure signal S are conducted by feed back steps, to detect a clogged state of the gas furnace. And, when the pressure signal value S is the same with the preset signal value Ss at the initial operation or a normal operation, the controller 16 stops the combustion and heating.

That is, if the pressure signal S is '0', the controller 16 shuts off the gas valve 16. In this instance, it is preferable that an informing step is provided before stopping the operation, in which the clogged state is informed to the user by either sounding the buzzer, or displaying on the display, so that the user comes to know the clogged state, easily. And, it is more preferable that a message display means and a light for visual effect or buzzer for hearing effect are used as informing means. And, as has been explained, it is preferable that a step for determining an factual clogged state by means of a timer in the step of controlling operation is provided for identifying a temporary clogging of the air supply pipe or the exhaust gas pipe. In the determining step, the timer measures a time period T lapsed since the clogged state is detected.

Then, the measured time T is compared to a preset time Ts at the controller 16. And, a new pressure signal S is provided again by a pressure difference between the inlet/outlet of the air supply fan 11, and compared to the preset signal SI at the controller 16 again. If the pressure signal S per a unit time period and the preset signal Ss within a set time period Ts is the same, it is determined that the present operation state is a clogged state, and, if the pressure signal S per a unit time period and the preset signal Ss within a set time period Ts is not the same even once, it is determined that the present operation state is a normal state. That is, if the measured time T is shorter than the preset time Ts when the pressure signal S and the preset signal Ss are the same, the re-providing step and the re-comparing step are repeated. And, in the re-providing step and the re-comparing step, if the measured time period T is longer than the preset time period Ts when the pressure signal S is the same with the preset signal Ss, it is determined that the present operation state is an abnormal state. On the other hand, in the re-providing step and the recomparing step, if the pressure signal S is not the same with the preset signal Ss, it is determined that the present operation state is a normal state. If it is determined in the determining step that the present operation state is the abnormal state, the abnormal state is informed to the user and the operation is stopped. And, if it is determined in the determining step that the present operation state is a normal, the combustion and heating is continued. In this determining step too, it is preferable that an informing step is provided for informing the user of the clogged state by buzzer or display before stopping the operation for easy perception of the clogged state by the user. Though the determining step of the present invention is not essential in the method for controlling operation, if it is included, a stoppage of operation of the gas furnace due to temporary clogged state can be prevented.

As has been explained, the device for sensing a pressure of the present invention permits to detect clogging both of the air supply pipe and the exhaust gas pipe during use of the gas furnace, by using pressure difference sensing means connected to the inlet/outlet of the air supply pipe. And, the device for sensing a pressure of the present invention has a simple structure and a low production cost as only one pressure difference sensing means is used. And, the method for controlling operation of the present invention can provide a more efficient operation of the gas furnace as the step for determining a factual clogged state is included, together with a device for sensing a pressure.

It will be apparent to those skilled in the art that various modifications and variations can be made in the device for sensing an internal pressure difference of the gas furnace, and the method for controlling operation of a gas furnace by using a pressure sensing device of the present invention without departing from the spirit or scope of the invention. Thus, it is intended that the present invention cover the modifications and variations of this invention provided they come within the scope of the appended claims and their equivalents.

What is claimed is:

1. A pressure sensing device in a gas furnace, comprising:

a first tube in communication with an air supply pipe on an inlet side of an air supply fan having a pressure identical to an inlet of the air supply fan;

a second tube in communication with an air supply pipe on an outlet side of the air supply fan having a pressure identical to an outlet of the air supply fan;

a pressure difference sensing means respectively connected to the first and second tubes for providing an electrical signal according to a pressure difference caused by pressure on the first and the second tubes; and a controller that receives the electric signal generated at the pressure difference sensing means, compares the electric signal to a preset value, and detects and/or determines clogging of the air supply pipe or an exhaust gas pipe in communication with the air supply pipe based on the results of the comparison.

2. The pressure sensing device as claimed in claim 1, further comprising a timer for measuring a time period since a clogged state is detected by the controller for re-determining the clogged state detected by the controller within a present time period.

3. The pressure sensing device as claimed in claim 1, further comprising an informing means for informing the clogged state of the air supply pipe or the exhaust gas pipe detected or determined at the controller.

4. The pressure sensing device as claimed in claim 3, wherein the informing means includes at least one selected from a character display for providing an error message, a light for a visual effect, and a buzzer for a hearing effect.

5. A pressure sensing device as claimed in claim 1, wherein the controller shuts off a gas valve for the gas furnace and stops operation of the gas furnace once the controller determines that the air supply pipe or the exhaust gas pipe is clogged.

6. A method for controlling operation of a gas furnace, comprising:

providing an electric signal by a pressure difference sensing device according to a pressure difference between an inlet and an outlet of an air supply fan disposed in an air inlet supply pipe during operation or a pre-purge step for staring operation of the gas furnace;

comparing the electric signal to a preset signal at a controller to detect and/or determine clogging of the inlet or outlet of the air supply fan based on the results of the comparison; and either stopping operation or continuing the operation according to a pressure state detected in the comparing step.

7. A method as claimed in claim 6, wherein the determining step includes measuring a time period since the clogged state is detected in the step (2), comparing a measured time period in the measuring step to a preset time period, re-providing the electric signal coming from the pressure difference between the inlet and outlet of the air supply fan when the measured time period is shorter than the preset time period in the comparing step, and re-comparing the electric signal in the re-providing step to the preset signal at the controller, wherein the re-providing step and the re-comparing step are repeated if the measured time period is shorter than the preset time period, and the present operation state is determined to be the clogged state if the measured time period is longer than the preset time period.

8. A method as claimed in claim 7, wherein the present operation state is determined to be a normal state if the re-provided electric signal in the signal re-comparing step is different from the preset signal.

9. The method as claimed in claim 6, further including informing the clogged state to the user by sounding a buzzer or displaying a message before stopping the operation if the present operation state is detected or determined to be the clogged state.

10. A pressure sensing device in a gas furnace, comprising:

a first tube in fluid communication with an air supply pipe on an inlet side of an air supply fan having a pressure identical to an inlet of the air supply fan;

a second tube in fluid communication with an air supply pipe on an outlet side of the air supply fan having a pressure identical to an outlet of the air supply fan; and a pressure difference sensor respectively connected to the first and second tubes that provide an electrical signal according to a pressure difference caused by pressure on the first and the second tubes; and a controller that receives the electric signal generated at the pressure difference sensor, compares the electric signal to a preset value, and detects and/or determines clogging of the air supply pipe or the exhaust gas pipe based on the results of the comparison.

11. The pressure sensing device as claimed in claim 10, further comprising a timer that measures a time period since a clogged state is detected by the controller to re-determine the clogged state detected by the controller within a present time period.

12. The pressure sensing device as claimed in claim 10, further comprising an informing device that informs a user of the clogged state of the air supply pipe or the exhaust gas pipe detected or determined at the controller.

13. The pressure sensing device as claimed in claim 12, wherein the informing device includes at least one selected from a character display that provides an error message, a light that provides a visual indicator, and a buzzer that provides an auditory signal.

14. The pressure sensing device as claimed in claim 10, wherein the controller shuts off a gas valve for the gas furnace and stops operation of the gas furnace once the controller determines that the air supply pipe or the exhaust gas pipe is clogged.

15. A device for detecting and/or determining clogging of an air supply pipe or an exhaust gas pipe in a gas furnace, comprising:

a first tube in communication with an air supply pipe on an inlet side of an air supply fan;

a second tube in communication with an air supply pipe on an outlet side of the air supply fan;

a detector respectively connected to the first and second tubes; and a controller that receives an electric signal generated by the detector, compares the electric signal to a preset value, and detects and/or determines clogging of the air supply pipe or an exhaust gas pipe in communication with the air supply pipe based on the results of the comparison.

* * * * *